US006202844B1

(12) United States Patent
Sedlmayr

(10) Patent No.: US 6,202,844 B1
(45) **Date of Patent: *Mar. 20, 2001**

(54) PALLET CONTAINER

(75) Inventor: Rudolf Sedlmayr, Kleinblittersdorf (DE)

(73) Assignee: Roth Werke GmbH, Dautphetal (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/254,971

(22) PCT Filed: Sep. 13, 1997

(86) PCT No.: PCT/EP97/05023

§ 371 Date: Mar. 16, 1999

§ 102(e) Date: Mar. 16, 1999

(87) PCT Pub. No.: WO98/12124

PCT Pub. Date: Mar. 26, 1998

(30) Foreign Application Priority Data

Sep. 19, 1996 (DE) ..... 196 38 199
Jun. 6, 1997 (DE) ..... 197 23 806

(51) Int. Cl.[7] ..... B65D 19/00
(52) U.S. Cl. ..... 206/386
(58) Field of Search ..... 220/23.91; 206/386, 206/600, 595, 599

(56) References Cited

U.S. PATENT DOCUMENTS

| | | | | |
|---|---|---|---|---|
| 4,909,387 | | 3/1990 | Schutz . | |
| 5,358,137 | | 10/1994 | Shuert et al. . | |
| 5,405,006 | * | 4/1995 | Burgdorf et al. | 206/386 |
| 5,501,334 | * | 3/1996 | Przytulla et al. | 206/386 |

FOREIGN PATENT DOCUMENTS

| | | |
|---|---|---|
| 0239709 | 10/1987 | (EP) . |
| 0509228 | 10/1992 | (EP) . |
| 9619397 | 6/1996 | (WO) . |

* cited by examiner

*Primary Examiner*—David T. Fidei
(74) *Attorney, Agent, or Firm*—Friedrich Kueffner

(57) ABSTRACT

A cage for receiving a plastic container in the overall arrangement of a pallet-type container, having a shallow tray (3) as base of the cage, the tray being arranged on a pallet or forming the top part of a pallet, and a grid casing as wall of the cage, the grid casing being connected to the border (28) of the tray (3), is constructed such that, on its bottom border, the grid casing has a web (19) which is supported on the pallet or, if the tray (3) forms the top part of the pallet (5), on a bottom part (11, 15) [sic] of the pallet and on which the tray (3) is supported by means of its border (28), and the border (28) of the tray (3), the web (19) and the pallet, or the bottom part (4) of the pallet, are connected to one another in a positively locking manner (31, 33; 35, 36).

26 Claims, 6 Drawing Sheets

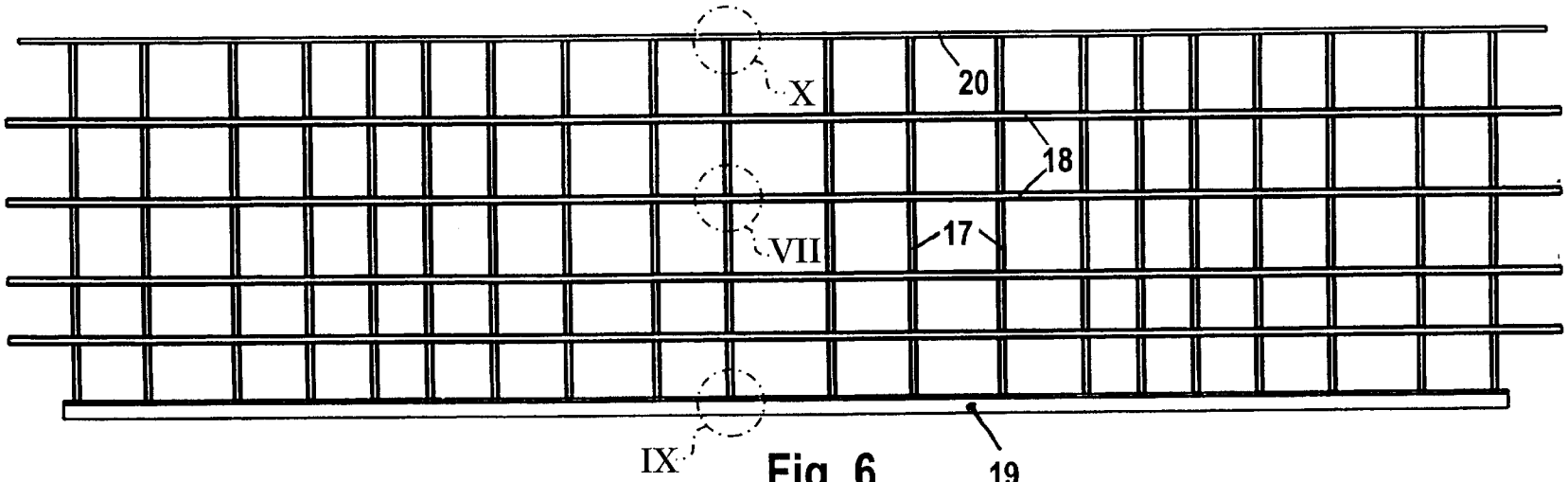
Fig. 6
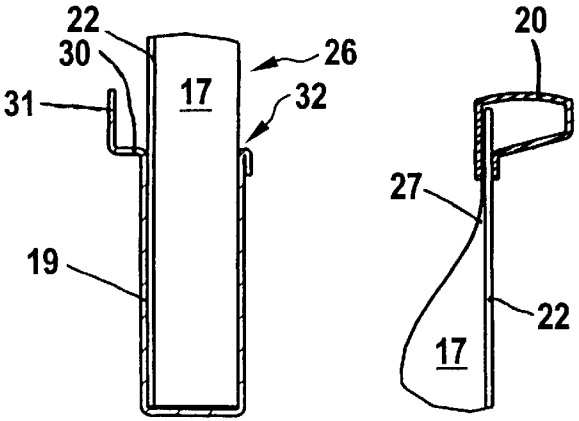
Fig. 10
Fig. 9
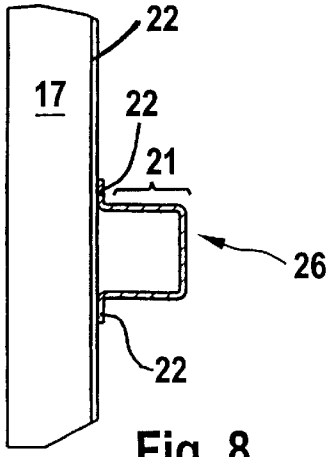
Fig. 8
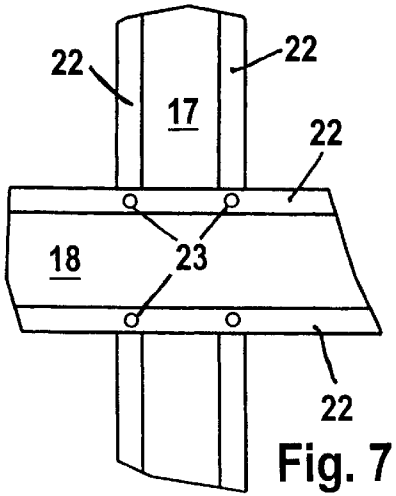
Fig. 7

Fig. 11
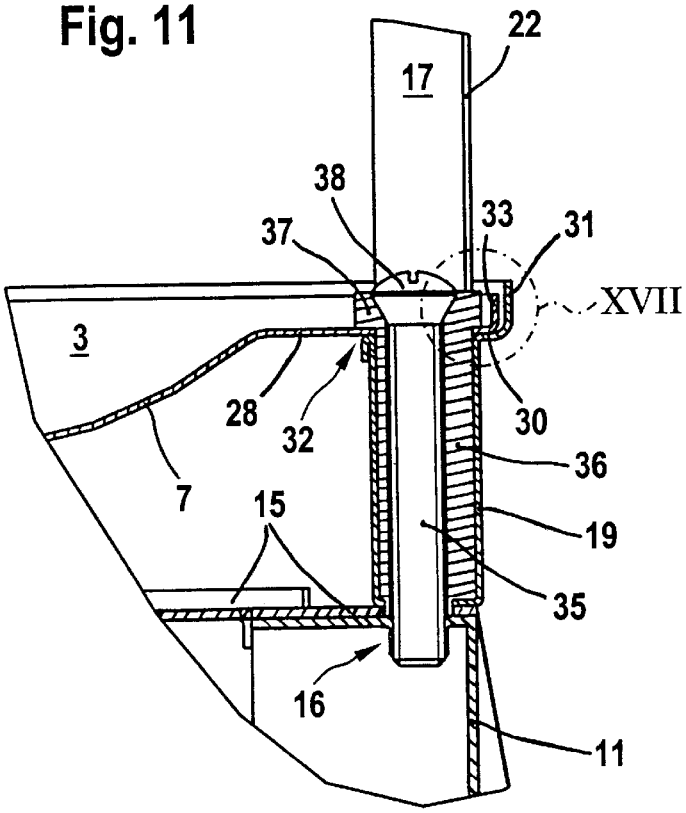
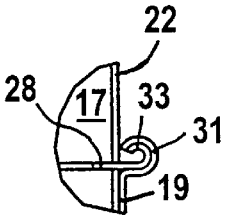
Fig. 17
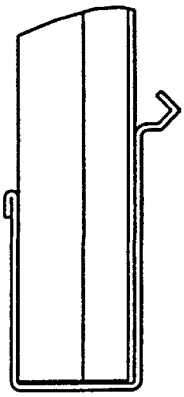
Fig. 12
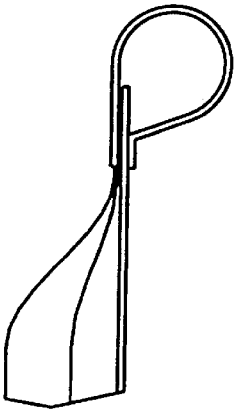
Fig. 13
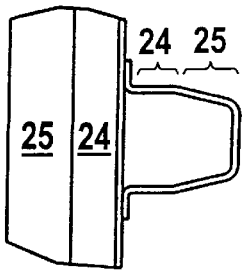
Fig. 14

PALLET CONTAINER

BACKGROUND OF THE INVENTION

1. Field of the Invention

The invention relates to a cage for receiving a plastic container in the overall arrangement of a pallet-type container for storing and/or for transporting substances, having a shallow tray as base of the cage, the tray being arranged on a pallet or forming the top part of a pallet, and a grid casing as wall of the cage, the grid casing being connected to the border of the tray.

2. Description of the Related Art

A pallet-type container with such a cage is known from DE 41 08 399 C1. In the case of this cage, the border of the tray is angled horizontally and then vertically upwards again and is thus configured as a seat for the grid casing; the grid casing is welded or screwed to said tray. Feet are fastened on the tray in the region of the tray arch which adjoins the horizontal bent-away section towards the inside.

As is outlined in the patent of addition DE 42 06 945 C1, swashing vibrations caused by liquid substances and vibrations transmitted by the transporting vehicle put this pallet-type container at risk, and this in turn adversely affects transporting safety. The solution to this problem proposed by DE 42 06 945 C1 is that, rather than the border of the tray being bent away outwards and upwards, said border is drawn downwards and then angled away outwards again; furthermore, a double base with hollow chambers is provided. The grid casing is accommodated at the bent-away section. The feet support the tray on the bent-away section.

All of this requires a high degree of production outlay. It also renders a fixed connection between the tray and the grid cage more difficult; in fact, this connection only comprises a few screws.

SUMMARY OF THE INVENTION

The object of the invention is to provide a further, expedient design of a pallet-type container. The design is to allow maximum strength along with minimal production outlay.

This object is achieved according to the invention by a cage of the type described in the introduction, in the case of which, on its bottom border, the grid casing has a web which is supported on the pallet or, if the tray forms the top part of the pallet, on a bottom part of the pallet, and on which the tray is supported by means of its border, and the border of the tray, the web and the pallet, or the bottom part of the pallet, are connected to one another in a positively locking manner.

The web preferably comprises an essential U-shaped profile, which surrounds the bottom ends of the grid bars. This configuration makes it possible to achieve high strength. The grid-bar ends may be welded to the two legs of the U-shaped profile. The weld points are only subjected to shear loading, and are thus loaded to a lesser extent than in the case of the abovementioned prior-art arrangement subjected to tensile loading. Even pinning of the grid bars to the two legs throughout would be possible in a comparatively simple manner, i.e. a positively locking mechanical connection which is at virtually no risk of rupturing.

The tray preferably has cutouts on the border for the through-passage of the grid bars and, between the grid bars, is supported on the web. In the case of the U-shaped profile, this thus allows support on both the legs of the profile. In principle, however, and depending on circumstances, support could also be restricted to the inner U-leg. The webs could also be of a different design and be seated on the grid bars on one side such that the border is located beside the grid bars.

A particularly advantageous development of the invention consists in the fact that the web comprises a profile which is flanged with the border of the tray. The flanging over the length of the border is considerably stronger than individual weld points. Moreover, it requires less production equipment. In addition, it allows a plastic tray to be connected to a metal grid casing. However, a combination of flanging and welding is also possible.

To give further details, the outer leg of the U-shaped profile preferably has an outwardly directed angled section on which the border of the tray is located, and the flanging is carried out after the angled section and above it. The border of the tray preferably has an upended section which is flanged together with the border of the profile and is enclosed by the border of the profile in a positively locking manner, said profile border preferably also being upended to begin with. These configurations are favourable in terms of both strength and production.

Otherwise, the parts are preferably connected by means of screws which engage through the border of the tray and through the web, or past the latter, into the pallet or the bottom part of the pallet. This produces a tensile connection throughout all the parts. With a sufficient number of screws, this connection could possibly replace the flanging.

However, other connecting means would likewise be possible, also other screwed connections, for example into the web from beneath.

The screws are expediently combined with spacers which span the distance between the border of the tray and the pallet, or the bottom part of the pallet, in order to support the tensile force of the screws and thus to permit a fixed screw connection without bending the web and/or the border of the tray. The spacers are preferably sleeves which enclose the screws. They may also be in the form of bored blocks.

In a particularly advantageous configuration of the invention, the sleeves pass through the border of the tray and bear on the border by means of a flange formed on them.

The flange then acts as a washer, and the sleeve can be inserted from the outside together with the screw.

The tray preferably has downwardly directed stamped formations which extend, at least approximately, into the plane of the bottom border of the web. As a result, a forklift truck can reliably grip beneath, and transport, the pallet-type container, if the tray forms the top part of the pallet; the pallet-type container rests directly on the fork by means of the webs and the stamped formations. When positioning the cage on a wooden pallet or a plastic pallet similar to this, the tray is supported on the top boards of the pallet by the stamped formations. If the top part of the pallet is formed by the tray itself, then the bottom part of the pallet has a crossmember which supports the tray from beneath.

It is proposed as being particularly advantageous in combination with the web provided according to the invention that the grid casing comprises intersecting vertical and horizontal grid bars, and the horizontal grid bars comprise an open profile which has two outwardly bent-away borders located in the same plane, and the vertical grid bars likewise comprise such a profile or comprise a closed profile which has at least one planar profile wall, and the horizontal grid bars are assembled with the vertical grid bars with the bent-away borders butting against one another, or with the bent-away borders of the horizontal profile bars butting against said planar profile wall of the vertical profile bars, and are welded to one another at the abutment surfaces and/or joined to one another by stamping and/or punching. The web can also be fastened well on the planar bent-away borders or abutment surfaces of the vertical profile bars. This applies, in particular, to the form of the U-shaped profile, of which the two legs can then have planar surfaces of contact with the grid bars and can be welded here appropriately well.

After the two bent-away borders, the open profile of the horizontal profile bars at least should merge into two parallel wall sections and, with a slight bend, these should be adjoined by a trapezoidal residual cross-section.

The pallet-type containers can move apart from one another at the trapezoidal residual cross-section if, in the event of being accidentally set down adjacent to one another, their grid casings become entangled.

If it is desired to increase the strength or to reduce the possibilities of accidents, the bent-away borders can be folded over at the border edges. The profile is thus stiffened and the border edges are rounded, a larger radius being produced at the same time.

For the top border of the grid casing, it is proposed that the grid-bar ends are pressed flat and surrounded by a profile which butts against the grid-bar ends by means of two parallel borders and, likewise on both sides, is welded to said grid-bar ends and/or joined to them by stamping and/or punching. This produces a strong top border for the cage, on which a further, identical pallet-type container can be positioned. Moreover, in order to increase the stability, in the vicinity of their top ends, various mutually opposite vertical grid bars are to have transverse bores in which crossmembers which are laid over the plastic container and engage on the relevant grid bars, by way of forked ends having corresponding bores, are pinned to these grid bars. Apart from strengthening the cage, the crossmembers serve to retain the plastic container in the cage in a positively locking manner and to prevent any possible arching of the top of the plastic container under pressure. A further configuration of the subject matter of the invention provides, as base of the case, a rectangular tray, of which the base surface, which is enclosed by an arched border region, is designed approximately in the form of a shallow saddleback roof or tent roof, of which the border slopes downwards slightly to both sides from the centre of one shorter rectangle side, and then along the two longer rectangle sides, and then opens into a channel which runs on the other short rectangle side and deepens towards the centre of this rectangle side. It is here that the outlet of the plastic container is located.

The base configured in this manner is supported against the border of the tray, said tray border being subjected to tensile loading in the process. This static concept is more favourable than the known solutions with reversed force flux. The tray may thus be dimensioned to be more lightweight; greater stability is achieved with the same dimensions.

The proposed design of the tray and the proposed grid casing comprising a bent, open profile, which may possibly be closed on the vertical grid bars, said profile likewise having a weight-reducing effect, provides an overall design for the cage and pallet-type container assembled according to the invention which has a particularly favourable stability to weight ratio.

BRIEF DESCRIPTION OF THE DRAWING

An exemplary embodiment of the invention is shown in the drawings, in which:

FIG. 6 shows a view of a grid for forming a grid casing of the pallet-type container, FIG. 7 shows a detail designated by VII in FIG. 6, on an enlarged scale, FIG. 8 shows the detail in FIGS. 6 and 7 as viewed from the left, FIG. 9 shows a detail designated by IX in FIG. 6, on an enlarged scale and as viewed from the right in FIG. 6, FIG. 10 shows a detail designated by X in FIG. 6, on an enlarged scale and viewed from the left in FIG. 6, FIG. 11 shows a detail designated by XI in FIG. 3 on an enlarged scale and in section, the section being located behind the plane of the drawing of FIG. 3, FIG. 12 shows, in mirror-inversion, a modification of FIG. 9, FIG. 13 shows a modification of FIG. 10, FIG. 14 shows a modification of FIG. 8, FIG. 17 shows a detail designated by XVII in FIG. 11 after the step of flanging has been carried out.

DESCRIPTION OF THE PREFERRED EMBODIMENTS

Figure 1:
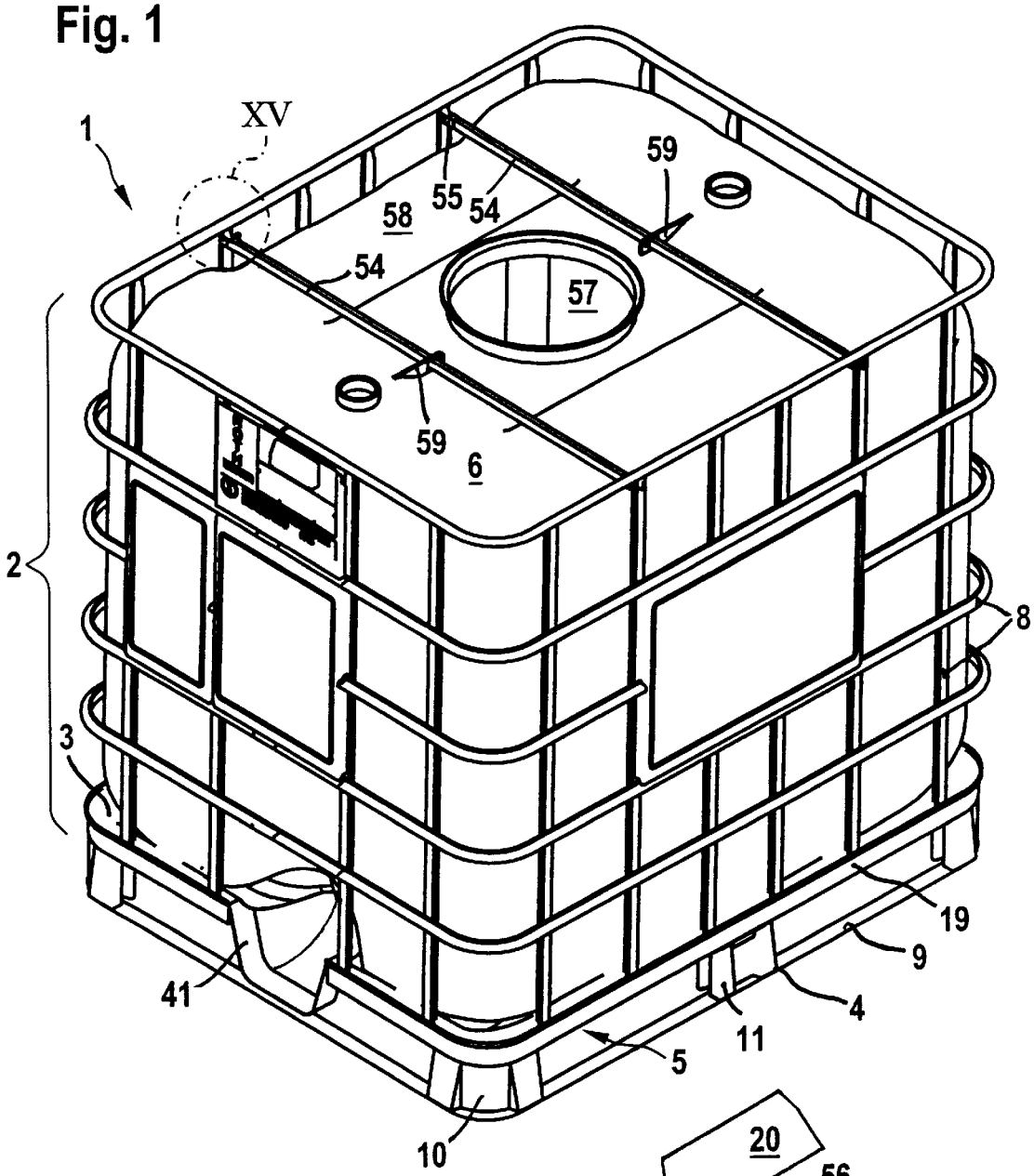
FIG. 1 shows an isometric illustration of a pallet-type container.
Figure 15:
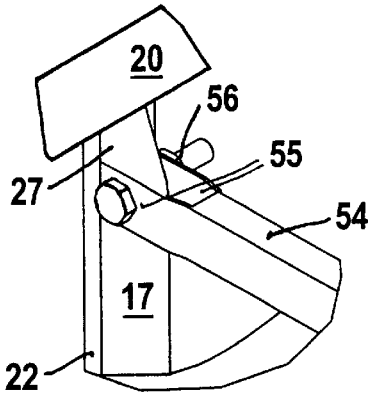
FIG. 15 shows a detail designated by XV in FIG. 1, on an enlarged scale.

The pallet-type container 1 comprises a cage 2, of which the base, which is configured as a shallow tray 3, is supplemented by a base framework 4 to form a pallet 5, and also comprises a plastic container 6 which is received by the cage. The plastic container 6 is produced, by blow-moulding, in cuboidal form with rounded edges and corners. To match the base of the plastic container, 6, the tray 3 has an arched border region 7. Level with the plastic container 6, the grid casing 8 of the cage 2 is adapted to the periphery of said container.

On a rectangular frame 9 made of round steel bars, the base framework 4 has four corner feet 10 and three feet 11 on the centres of one shorter rectangle side and of the two longer rectangle sides. The latter two feet 11 are spanned by a crossmember 12. The feet and the crossmember are sheet-metal pressed parts. Those feet 11 on which the crossmember 12 is located are shorter, by the thickness of the sheet metal of the crossmember, than the other feet 11 and 12. The crossmember 12 has upwardly angled side walls 15 which are in shallow-gable form and are bent away outwards again at the top border. In correspondence with the crossmember 12 tapering towards the centre, the side walls 15 are inflected slightly. The shallow gable form of the crossmember 12 is matched to the cross-sectional shape of the base 3, which the crossmember supports from beneath, and this cross-sectional shape will be described at a later stage in the text. Formed on the corner feet 10 are positioning surfaces 13, which project obliquely towards both sides, and thus, at the same time, lateral protrusions 14. The feet 11 have corresponding positioning surfaces 13 and protrusions 14 on one side. Through-passages 16 for self-tapping screw threads for fastening the grid casing 8 and the tray 3 are made on the top sides of the corner feet 10, feet 11 and crossmember 12.

The grid casing 8 has been produced from the grid shown in FIG. 6 by being bent at the four side edges of the cage 2 and closed at the centre of one narrower side surface.

The grid is made up of vertical grid bars 17, horizontal grid bars 18, a U-shaped profile, which forms a web 19 and surrounds the bottom ends of the vertical grid bars 17, as well as a profile 20 which surrounds the top ends of the vertical grid bars 17. The grid bars 17 and 18 comprise a hat profile which, on a cross-sectionally square profile section 21, has two outwardly bent-away borders 22. At the points of intersection, the grid bars butt against one another by means of the bent-away borders 22 and are spot welded, projection welded or resistance welded on the contact surfaces, as is indicated in FIG. 7 at 23. FIG. 14 shows the modification where the profile section 21 is replaced by a section made up of a rectangular cross-sectional part 24 and a trapezoidal cross-sectional part 25.

The cross-section of the web 19 is illustrated in FIG. 9. In the U-shaped profile of the web 19, the hat profile of the grid bars 17, which reach as far as the base of the profile, butts against the two legs, to be precise the bent-away borders 22 butting against the outer leg and the end surface 26 of the profile section 21 butting against the other leg. Welding is possible on all three contact surfaces. It is carried out at least on the two bent-away borders 22. The outer profile leg is bent outwards at right angles, this producing a horizontal bearing surface 30 and a vertical flange border 31. Level with the section which has been bent at right angles, the inner profile leg is folded over and thus forms a stiffened rest 32. Further details will be given of these functions.

At the top border of the grid, the hat profile of the grid bars 17 is pressed flat at 27. The profile 20 which is placed in position here grips the pressed-flat section on both sides and is welded thereto on both sides. The grid with its favourable strength to weight ratio, straightforward and controlled welding and the possibility of all-round galvanization could also be used, with or without surrounding profiles, for purposes other than the pallet-type container described, and possibly also in an arrangement in which those grid bars which run in one direction are not aligned vertically and those grid bars which run in the other direction are not aligned horizontally; furthermore, connection of the grid bars to the abutment surfaces could be executed differently, e.g. by a combination of welding and joining.

The arched border region 7 of the tray 3 is adjoined by a border 28 which is angled into the horizontal and, at the end, the tray has a narrow upended section 33. The upended section 33, however, would not be necessary. In the manner illustrated in FIG. 11, the tray 3 is laid, by means of the border 28, on the rest 32 and the bearing surface 30 of the web 19, the grid bars 17 being located in cutouts 29 in the border 28 which are adapted to them. In the production of the cage, the tray 3 is introduced, from above, into the grid casing 8 which, at this stage, has been shaped but has still not been welded closed and is therefore still loose. Once the tray is located on the web 19, the grid casing is closed by its horizontal-bar ends, which overlap one another, being welded and/or joined by stamping and/or punching. In this state, the flange border 31 of the web 19 and the upended section 33 on the border 28 of the tray 3 are flanged to one another, as shown in FIG. 17. Welding is also possible, e.g. of 6 to 7 mm in width and at distances of from 20 to 30 mm from centre to centre. Spot welding, projection welding or seam welding are envisaged in particular. The now finished cage 2 is mounted on the base framework 4. The final state of this mounting operation is shown in FIG. 11, with the exception of the left-hand circled detail, which illustrates the abovementioned earlier state of the mounting operation and, in the end state, should be replaced by one of the two circled details on the right.

The cage 2 is located with the web 19 on the feet 10 and 11. Via each foot 10 or 11, a sleeve 36, through which a screw 35 passes, is inserted into the web 19 through a bore 34 in the border 28 of the tray 3. The sleeve 36 is located on the border 28 of the tray 3 by means of a flange 37 and on the base of the U-shaped profile, which forms the web 19, by means of its bottom end. The screw has its fillister head 38 seated in the top end of the sleeve 36 and itself engages through a bore in the base of the U-shaped profile and into the through-passage 16 made in the foot, at which location it has tapped itself a thread. At the two feet 11 which bear the crossmember 12, the web 19 is located on the sheet metal of the crossmember 12 which, over the through-passage 16 of the foot 11, has a clearance 39 of somewhat larger cross-section, the screw 35 passing through said clearance 39.

The length of the sleeve 36 is dimensioned such that the flange 37 presses on the border 28 of the tray 3 and the bottom end of the sleeve 36 presses on the base of the web 19.

Figure 2:
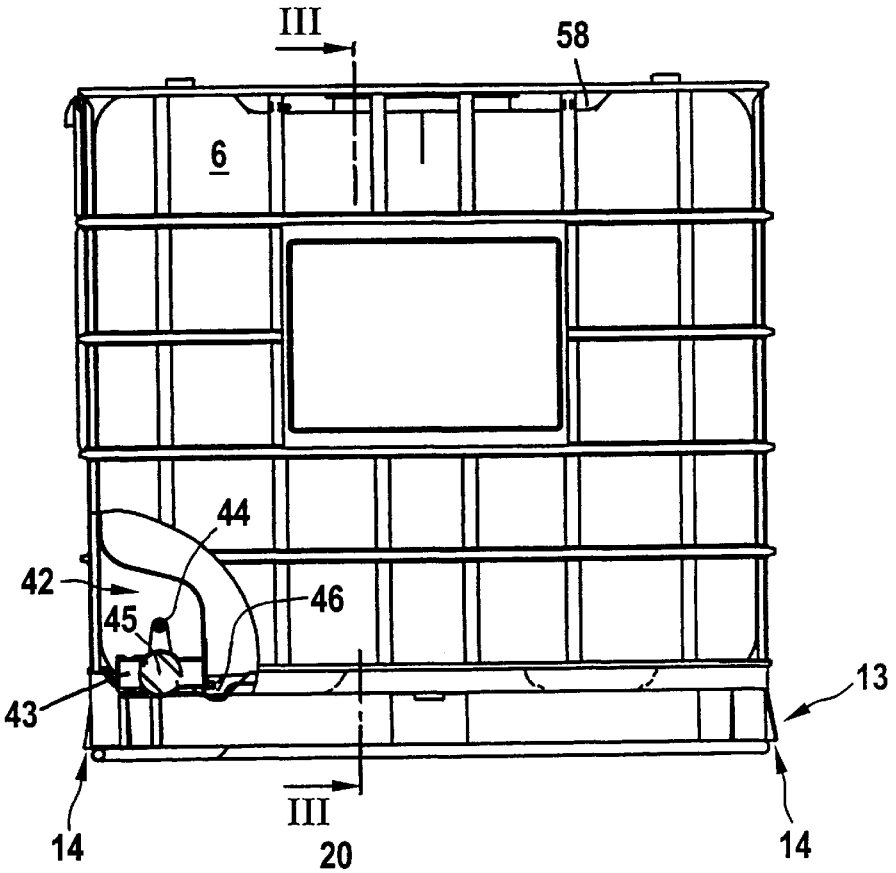
FIG. 2 shows the pallet-type container in a side view from the front right according to FIG. 1, partly in central section.
Figure 3:
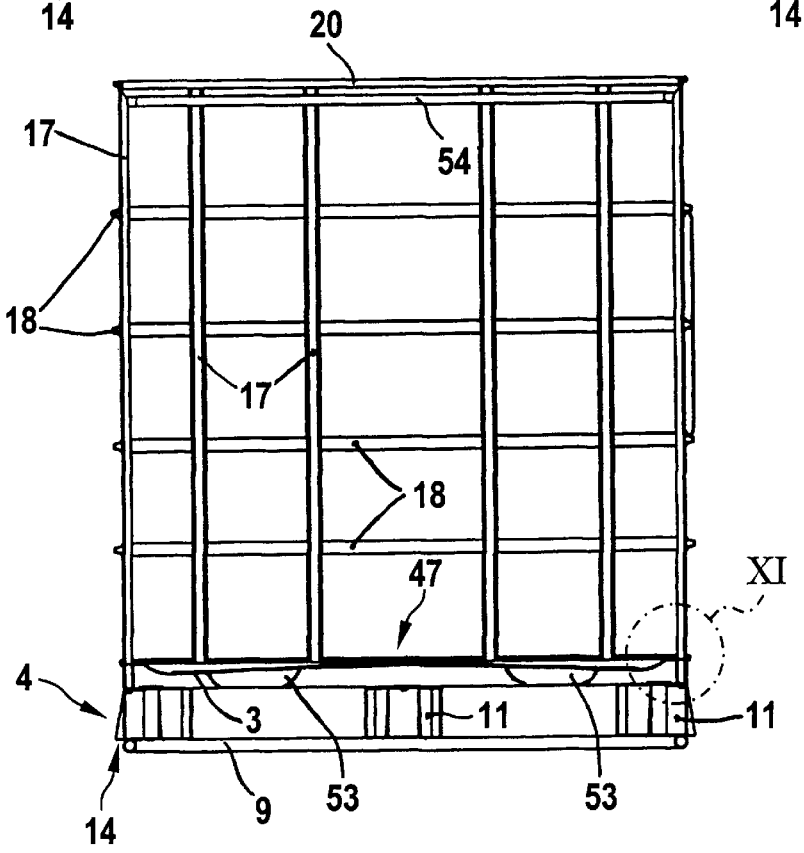
FIG. 3 shows a section through a cage of the pallet-type container along line III—III in FIG. 2.
Figure 4:
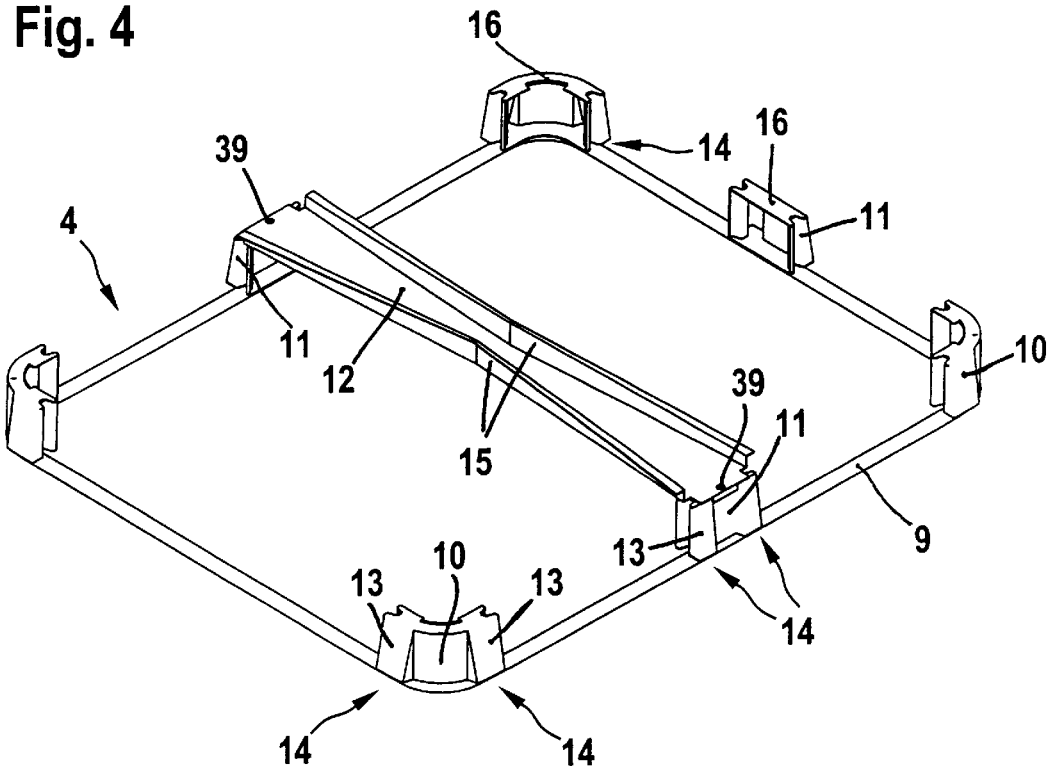
FIG. 4 shows an isometric illustration of a base framework as the bottom part of the pallet.

At the centre of one shorter rectangle side, the tray 3 has an indent 40. In this case, however, the border 28 is spanned by a support 41 which is curved out downwards and takes the place of a foot 11 in the pallet 5. Above the indent 40, the plastic container 6 also has a recess 42. Located in the resulting space is a discharge stub 43, which only appears in FIG. 2, with a discharge valve 45 which can be actuated by a handle 44. The discharge stub 43 is fitted on a protuberance 46 of the plastic container 6, this protuberance, at the border of the indent 40, projecting downwards into the latter.

The base surface of the tray 3 within the arched border region 7 is essentially designed in the form of a shallow saddleback roof with a ridge 47 extending between the centres of the shorter rectangle sides. However, the ridge 47 and the roof surfaces also have a slight inflection to form a tent roof, this producing a shallow roof tip 48 and two further inflection lines 49 which extend therefrom. Accordingly, the ridge 47 slopes very slightly downwards to both sides from the roof tip 48 and the two further inflection lines 49 slope downwards to a noticeable degree. The roof border slopes downwards slightly to both sides from the end point 50 of the ridge on one shorter rectangle side, and then along the two longer rectangle sides, in order finally to open into a channel 51 which runs on the other short rectangle side and becomes deeper towards the indent 40. The channel 51 is interrupted at the indent 40. It only follows that with part of its cross-section, although this includes part 52 of the channel base. The protuberance 46 of the plastic container 6 which is located here extends on both sides up to the channel 51 and into the latter.

Figure 5:
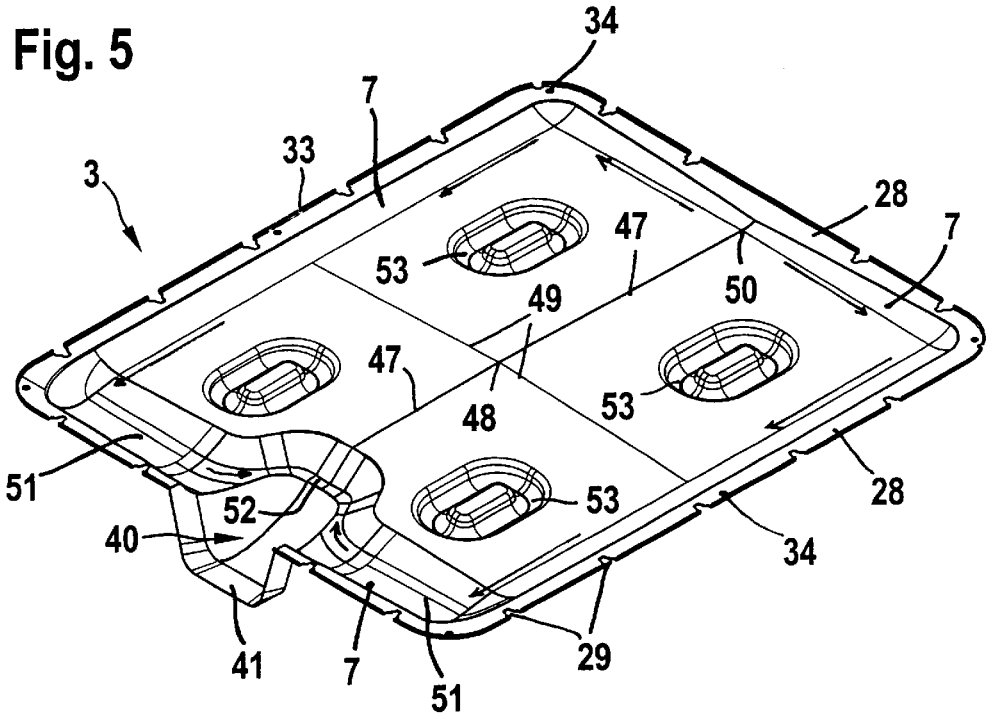
FIG. 5 shows a base of the pallet-type container, the base, as top part of the pallet, belonging to the base framework, in the same isometric illustration.

Starting from a certain preshaped formation, the base of the plastic container adapts itself more or less permanently, under the pressure of the liquid stored in it, to the shallow roof form of the tray base. The container can thus be completely emptied in the direction depicted by the arrows in FIG. 5.

In the four roof sections divided up by the ridge 47 and the further inflection lines 49, the tray 3 is provided with four downwardly directed stamped formations 53, of which the undersides, together with the underside of the web 19, are located in a common horizontal plane. A forklift truck can thus pick up the pallet-type container without tilting it. The depressions on the top side of the stamped formations 53 can be compensated by filling elements.

The pallet-type container can be set down on the top profile 20 of the grid casing of an identical pallet-type container by way of the protrusions 14 on the feet 10 and 11. The oblique positioning surfaces 13 located above the protrusions 14 have the task of ensuring that, when identical pallet-type containers are set down adjacent to one another, the distance which is necessary in relation to the horizontal grid bars 18 is obtained. Two crossmembers 54 engage on mutually opposite vertical grid bars 17 by means of forked ends 55 and are connected thereto by bolts 56 which are inserted through aligned transverse bores in the fork legs and the grid bars 17. The hat profile or also a closed rectangle profile of the vertical grid bars 17 permits this method of fitting the crossmembers, which is straightforward and favourable in terms of force. On either side of the filling opening 57, the crossmembers run in a flux shallow hollow on the top side of the plastic container 6. They are gripped centrally by container-top webs 59 projecting out on the two borders of the hollow 58.

All the constituent parts of the cage 2 and of the base framework 4 preferably consist of galvanized sheet steel.

Figure 16:
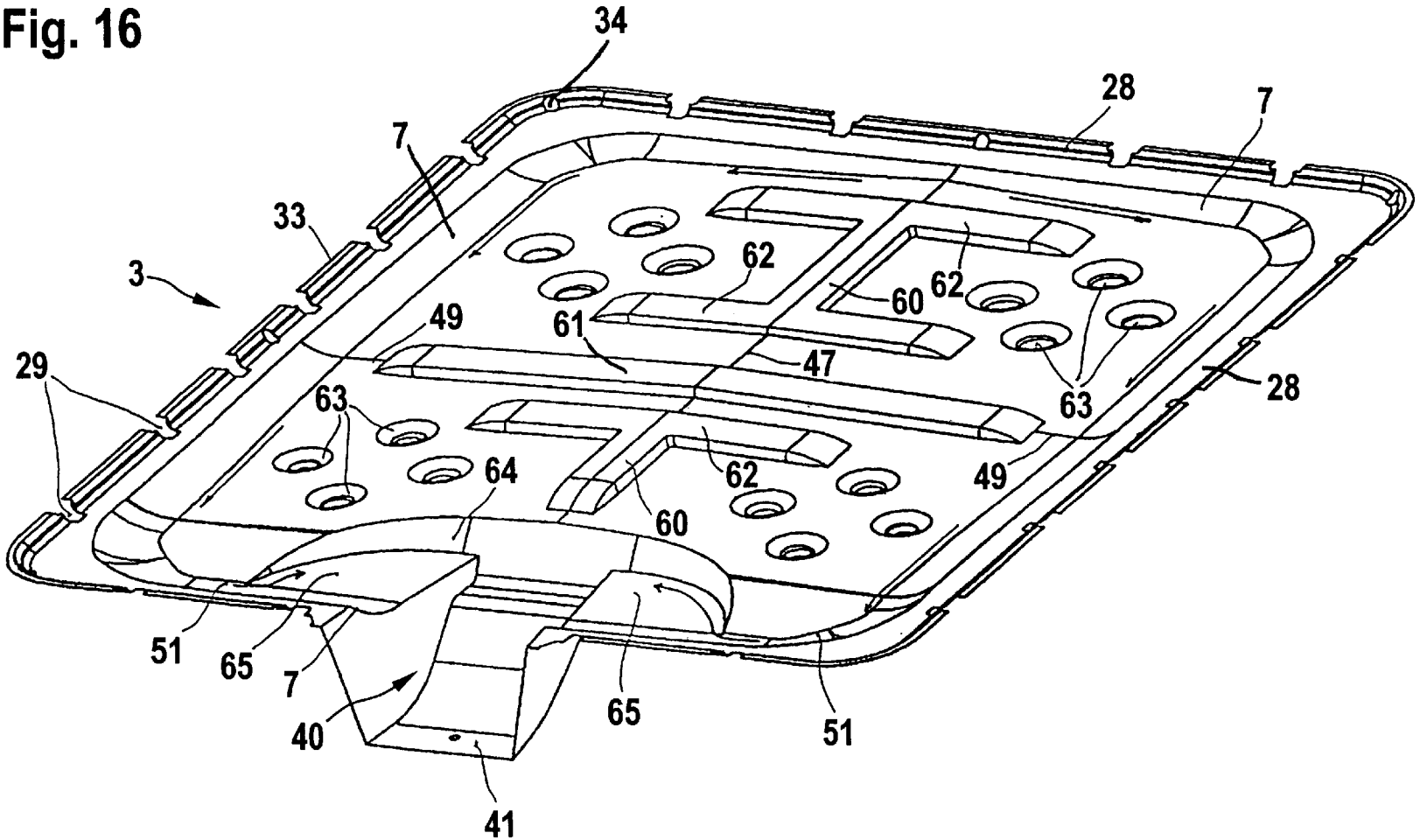
FIG. 16 shows a modification of FIG. 5.

In the base according to FIG. 16, maintaining the basic configuration of the shallow saddleback roof described, cross-sectionally rectangular upwardly directed ribs 60 and 61, which strengthen the design, are stamped on the ridge 47 and the further inflection lines 49. With the exception of the points behind the indent 40, further such ribs 62 are provided transversely at the ends of the ribs 60. The ribs 61 and 62 run beyond the ridge 47. The ribs 62 are shorter than the rib 61, which extends into the vicinity of the arched border region 7. Provided instead of each of the stamped formations 53 are in each case four smaller stamped formations 63 which are of round cross-section and of which the undersides, together with the underside of the web 19, are located in a common horizontal plane. Moreover, the indent 40 is formed somewhat differently. The channel 51 is fully interrupted; in this case, it terminates with two surfaces 65 which are inclined towards one another and towards the arched, oblique wall 64 of the indent 40 and into which said channel merges beforehand. The configuration of the tray 3 according to FIG. 5 or FIG. 16 within the border 28 is particularly advantageous within the context of the cage 2 described; the tray 3 remains shallow and the vertical extent of the web 19 need not be undesirably large. In principle, however, this configuration may also be used in other overall designs of the cage. Furthermore, the tray may be the base of a sheet-metal container for receiving a plastic container.

What is claimed is:

1. A cage for receiving a plastic container in an overall arrangement of a pallet-type container for storing and for transporting substances, the cage comprising a shallow tray as a base of the cage mounted on a pallet or forming an upper portion of the pallet, and a grid casing forming a wall of the cage, the grid casing being comprised of a plurality of grid bars having bottom ends, the grid casing having at a bottom border thereof a web mounted at the bottom ends of the grid bars and directly supported by the pallet or, if the tray forms the upper portion of the pallet, by a lower portion of the pallet, and fastened to the pallet or the lower portion of the pallet by screwing, the tray having a tray border configured to rest on the web, wherein the web is comprised of a profile having a flanging border and the tray border and the flanging border of the profile are connected by flanging in a positively locking manner.

2. The cage according to claim 1, wherein the web is comprised of an essentially U-shaped profile which surrounds the bottom ends of the grid bars.

3. The cage according to claim 1, wherein the tray has cutouts at the tray border for receiving the grid bars, wherein the tray border rests on the web between the grid bars.

4. The cage according to claim 1, wherein the U-shaped profile has an outer leg provided with an outwardly directed angled section, wherein the tray border rests on the angled section, and wherein the flanged connection is effected following the angled section and thereabove.

5. The cage according to claim 4, wherein the tray border has an upended section flanged together with an also upended border of the profile constituting the flanging border, and wherein the tray border is surrounded in a positively locking manner by the flanging border.

6. The cage according to claim 1, comprising screws extending through the tray border and one of through the web and past the web, and into the pallet.

7. The cage according to claim 6, comprising sleeve-shaped spacers enclosing the screws for bridging a distance between the tray border and the pallet or, if the tray forms the upper portion of the pallet, the lower portion.

8. The cage according to claim 7, wherein the sleeve-shaped spacers extend through the tray border, wherein each spacer has a flange formed thereon, and wherein the flanges of the spacers rest on the tray border.

9. The cage according to claim 1, wherein the lower portion of the pallet comprises pallet feet located at corners and centers of sides of the pallet, wherein the pallet feet have pressed-in through-passages for receiving self-tapping screw threads.

10. The cage according to claim 9, wherein the pallet feet have protrusions combined with obliquely projecting positioning surfaces, such that the pallet-type container is adapted to be placed with the protrusions on an identical pallet-type container.

11. The cage according to claim 9, wherein the lower portion of the pallet has a crossmember for supporting the tray.

12. The cage according to claim 1, wherein the tray has downwardly directed stamped formations extending at least approximately into a plane of a bottom border of the web.

13. The cage according to claim 1, wherein the grid casing is comprised of intersecting vertical and horizontal grid bars, wherein the horizontal grid bars are each formed by an open profile having two outwardly bent-away borders located in a plane, and the vertical grid bars are each formed by an open profile with two outwardly bent-away borders and a closed profile having at least one planar profile wall, wherein the horizontal grid bars are connected to the vertical grid bars with the bent-away borders abutting against one another, wherein the bent-away borders of the horizontal profile bars are abutting against the planar profile wall of the vertical profile bars, and wherein the connection is effected one of by welding and joining by stamping or punching.

14. The cage according to claim 13, wherein each open profile has adjacent the two bent-away borders two parallel wall sections and adjacent the wall sections with a slight bent a trapezoidal residual cross-section of the profile.

15. The cage according to claim 14, wherein each bent-away border is folded over at a border edge.

16. The cage according to claim 13, wherein the profiles of the grid bars are composed of bent galvanized sheet steel.

17. The cage according to claim 2, wherein the bottom ends of the grid bars are welded to both sides of the U-shaped profile.

18. The cage according to claim 1, wherein top ends of the grid bars are pressed flat and surrounded by a profile resting against the grid bar ends with two parallel borders and connected at both sides by one of welding and joining by stamping or punching.

19. The cage according to claim 13, wherein the vertical grid bars have adjacent top ends thereof transverse bores, further comprising crossmembers having forked ends provided with bores, and wherein the transverse bores are connected by pins to the bores of the crossmembers.

20. The cage according to claim 1, wherein the tray is rectangular and has a base surface enclosed by an arched border region, wherein the tray has approximately a shape of a shallow saddleback roof or tent roof, wherein a border of the roof slopes downwardly slightly towards both sides from a center of one shorter rectangle side and then along both longer rectangle sides and then opening into a channel running on the other short rectangle side and becoming deeper towards the center of the short rectangle side.

21. The cage according to claim 20, wherein the base surface is essentially a shallow saddleback roof with a ridge extending between the center of the shorter rectangle sides, and wherein the ridge and the roof surfaces have a comparatively slight inclination to form a tent roof.

22. The cage according to claim 20, wherein at least one upwardly stamped rib extends along the ridge of the saddleback roof.

23. The cage according to claim 21, wherein an upwardly stamped rib extends on each inflection line of the tent roof, wherein the inflection lines extend perpendicularly of the ridge.

24. The cage according to claim 22, comprising additional upwardly stamped ribs extending parallel to the upwardly stamped rib.

25. The cage according to claim 20, wherein an indent is provided at a center of the other short rectangle side, wherein the channel is interrupted at the indent and terminates with two surfaces which are inclined towards one another and towards the center of the base, wherein the channel initially extends towards the surfaces.

26. The cage according to claim 20, wherein the tray has downwardly directed stamped formations with undersides located in a common horizontal plane.

* * * * *